US005285582A

United States Patent [19]

Kouchi et al.

[11] Patent Number: 5,285,582

[45] Date of Patent: Feb. 15, 1994

[54] OVEN FOR A TRANSVERSE STRETCHING APPARATUS

[75] Inventors: Kunihiro Kouchi; Kimiyasu Hanaki, both of Hiroshima, Japan

[73] Assignee: The Japan Steel Works, Ltd., Tokyo, Japan

[21] Appl. No.: 883,387

[22] Filed: May 15, 1992

[30] Foreign Application Priority Data

May 27, 1991 [JP] Japan ..... 3-225434

[51] Int. Cl.[5] ..... F26B 13/00

[52] U.S. Cl. ..... 34/155; 34/229; 34/41

[58] Field of Search ..... 34/23, 41, 155, 156, 34/158, 162, 163, 222, 229

[56] References Cited

U.S. PATENT DOCUMENTS

| | | | |
|---|---|---|---|
| 2,144,919 | 1/1939 | Gautreau | 34/156 |
| 3,739,491 | 6/1973 | Creapo et al. | 34/229 |
| 4,498,250 | 2/1985 | Gageur et al. | 34/155 |
| 4,665,627 | 5/1987 | Wilde et al. | 34/41 |
| 4,774,770 | 10/1988 | Langer et al. | 34/158 |
| 4,815,181 | 3/1989 | Dornier et al. | 34/158 |
| 4,905,381 | 3/1990 | Poterala | 34/155 |
| 5,142,795 | 9/1992 | Abbott | 34/155 |

FOREIGN PATENT DOCUMENTS 62-273825 11/1987 Japan .

*Primary Examiner*—Henry A. Bennet
*Assistant Examiner*—Denise L. Gromada
*Attorney, Agent, or Firm*—Sughrue, Mion, Zinn, Macpeak & Seas

[57] ABSTRACT

An oven 1 includes a nozzle module 4 which is constructed such that a plurality of nozzle units 6 are alternately connected to an opposing pair of air chambers 5 arranged on the opposite sides of a conveyor 2. Each nozzle unit 6 has an upper nozzle 10 and a lower nozzle 11 both of which base end sides are pivotally supported to turn about support shafts 13 and 15 and of which foremost end sides are operatively supported by opening/closing units 16. Each opening/closing unit 16 has an elongated flexible member 17 suspended from a sprocket 18, and the opposite ends of the elongated flexible member 17 are operatively connected to the foremost end sides of the upper and lower nozzles 10 and 11. As the sprocket 18 is rotated, the upper and lower nozzles 10 and 11 are turned in the upward/-downward direction, whereby each nozzle unit 6 is opened or closed in the vertical direction. A radiator 7 is arranged on the conveyor 2 side relative to each air chamber 5 while extending in the vertical direction.

3 Claims, 3 Drawing Sheets

OVEN FOR A TRANSVERSE STRETCHING APPARATUS

BACKGROUND OF THE INVENTION

1. Field of the Invention

The present invention relates generally to a transverse stretching apparatus for stretching a film such as a resin film, or the like, to a predetermined width. More particularly, the present invention is an oven including a nozzle module for allowing a film to be subjected to heat treatment by blowing hot air toward the film from above and below.

2. Description of the Related Art

A transverse stretching apparatus is generally constructed such that the opposite ends of a film to be transversely stretched are captured by a conveyor and the film is then subjected to a series of treatments including preheating, stretching, thermal curing and cooling, while moving through an oven, until a predetermined width is obtained.

The oven includes a single nozzle module or a plurality of nozzle modules in each treatment region so that a film is heated up to a predetermined temperature. A typical conventional oven of the aforementioned type is disclosed in Japanese Laid-Open Patent No. 273825/1987. Specifically, the oven is constructed such that an opposing pair of air chambers, each including a radiator, are arranged on the opposite sides of a film passage and a plurality of nozzle units each having an upper nozzle for blowing a hot air over the entire width of a film from above and a lower nozzle, arranged opposite to the upper nozzle, for blowing a hot air over the entire width of the film from below, are alternately connected to the air chambers to constitute a nozzle module.

With the conventional oven constructed in the above-described manner, hot air is distributively supplied from the air chambers and flows in the upper and lower nozzles of adjacent nozzle units in the opposite direction, thus a slight temperature gradient appears in the upper nozzle across the whole width of the film and a slight temperature gradient appears in the lower nozzle across the whole width of the same so as to substantially cancel each other out. Consequently, the appearance of a temperature gradient over the whole nozzle module is suppressed, whereby temperature distribution becomes uniform across the entire width of the film passage. However, since the radiators are arranged on the film passage side of the air chamber while extending in parallel with the film passage, the base end side of each nozzle must have a stepped configuration in order to avoid any interference with the radiator and to assure that the upper and lower nozzles of each nozzle unit are connected to the air chambers with a predetermined distance therebetween. Thus, the geometrical structure of each nozzle is very complicated.

In addition, with respect to the conventional oven, the front nozzle unit can be opened in the forward direction, while the rear nozzle unit can be opened in the rearward direction. However, since the intermediate nozzle unit is fixedly secured to the air chambers, a sufficiently wide working space cannot be reserved for an operator to perform inspection, maintenance service, removal of a broken film or cleaning of the oven. Accordingly, these services are difficult to perform.

SUMMARY OF THE INVENTION

The present invention has been made with the foregoing limitation of conventional devices in mind and its objective is to provide an oven employable for a transverse stretching apparatus wherein a temperature distribution can be uniform across the entire width of a film passage without the necessity of a geometrical configuration of each nozzle. In addition, inspection, maintenance service, removal of broken film from the oven, cleaning the interior of the oven, or the like, can be easily performed.

To achieve the above-mentioned objects, the present invention is an oven employable for a transverse stretching apparatus having an opposing pair of air chambers, each including a radiator, arranged on opposite sides of a film passage. A plurality of nozzle units each having an upper nozzle for blowing hot air over the entire width of the film passage from above and a lower nozzle, arranged opposite to the upper nozzle, for blowing hot air over the entire width of the film passage from below are alternately connected to the air chambers to constitute a nozzle module. Each nozzle unit is vertically openably connected to the air chambers so that the upper chamber is turned in the upward direction with the base end side thereof as a fulcrum and the lower nozzle is turned in the downward direction with the base end side thereof as a fulcrum.

Each nozzle unit is operatively connected to an opening/closing unit for simultaneously turning the upper and lower nozzles in the upward/downward direction. Preferably, the opening/closing unit has an elongated flexible member suspended from a rotational member, and the opposite ends of the elongated flexible member are operatively connected to the foremost ends of the upper and lower nozzles. The radiators are arranged on the film passage side relative to each air chamber and extend in the vertical direction.

DETAILED DESCRIPTION OF THE PREFERRED EMBODIMENT

Figure 1:
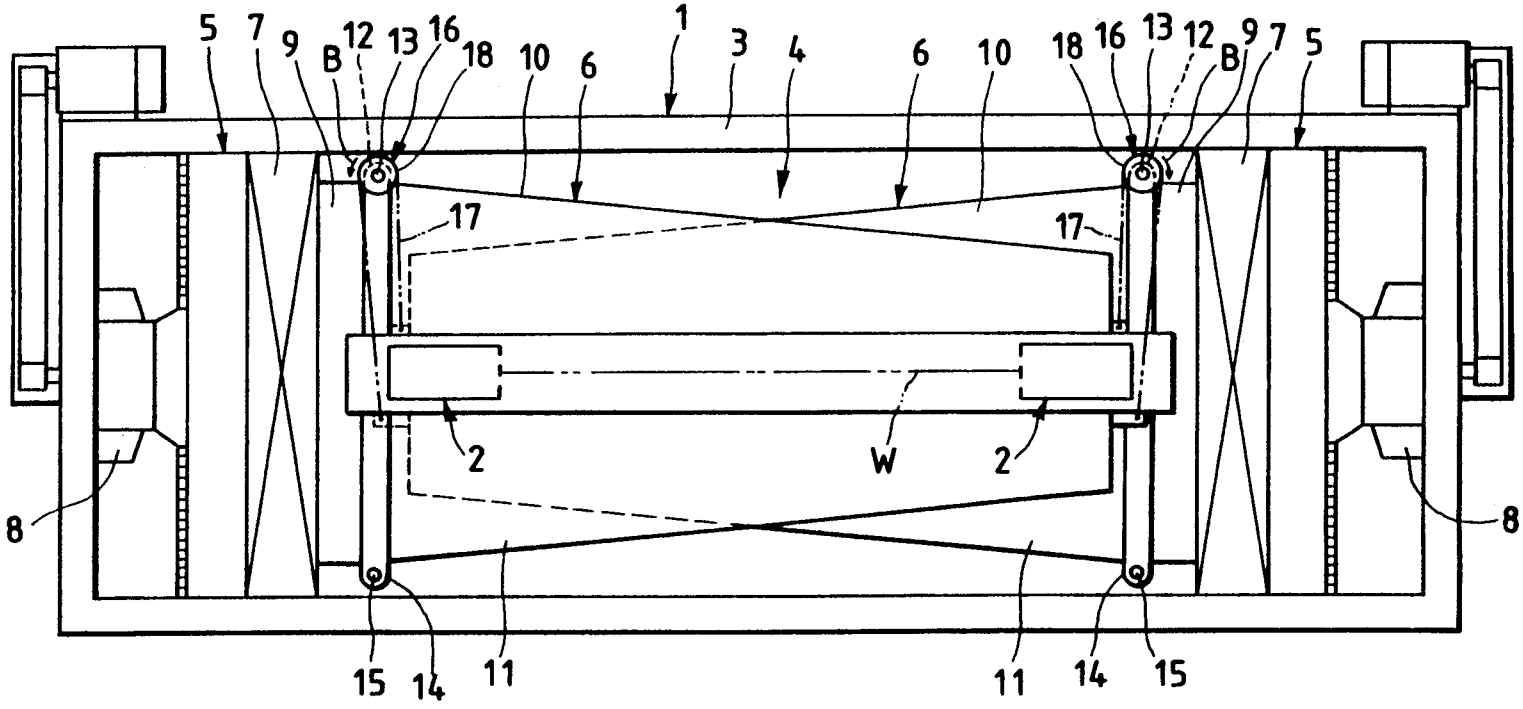
FIG. 1 is a schematic sectional view of an oven employable for a traverse stretching apparatus in accordance with a preferred embodiment of the present invention, taken along line X—X in FIG. 2.
Figure 2:
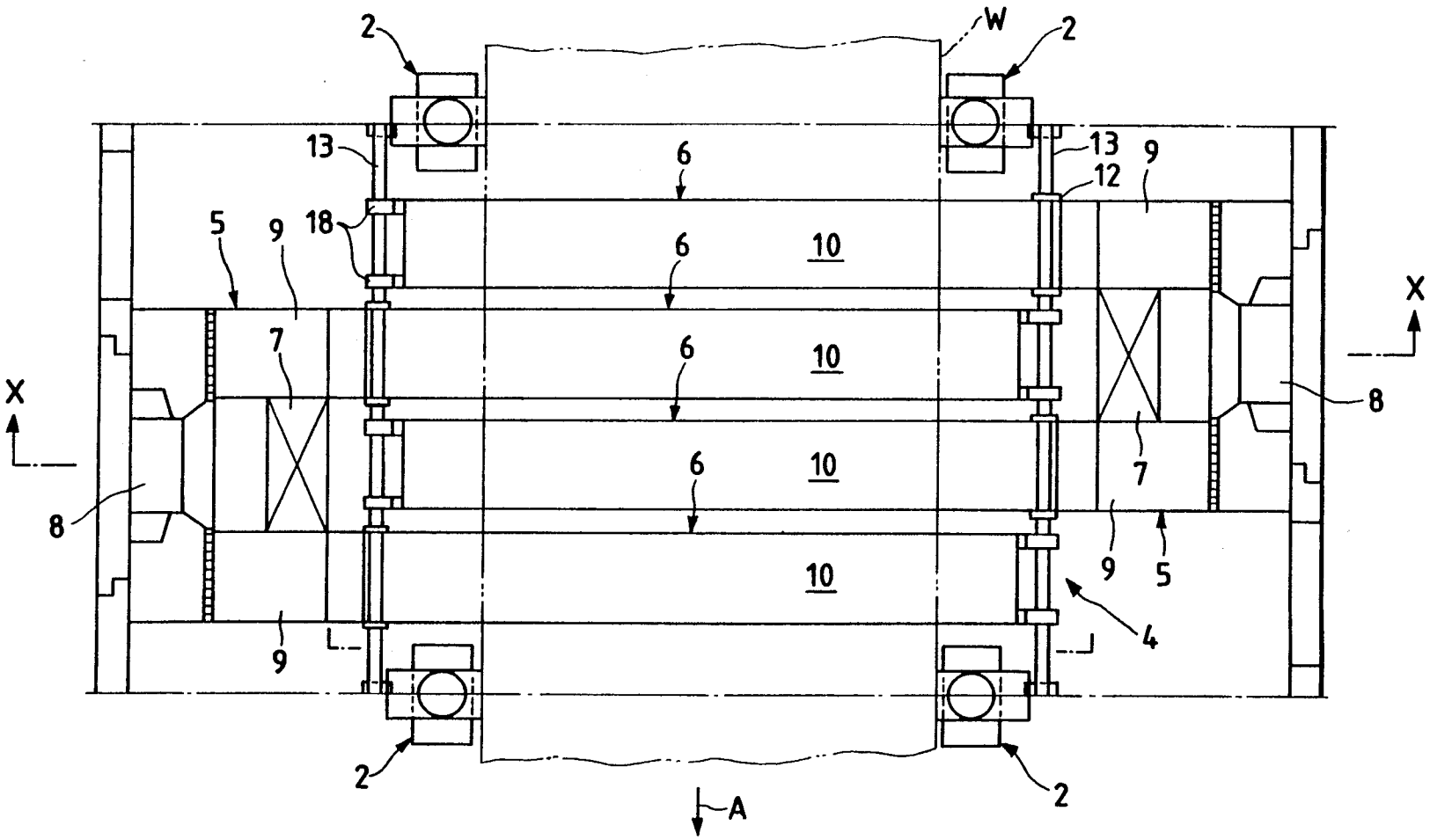
FIG. 2 is a schematic plan view of the oven in partial section.

The present invention will now be described in detail with reference to the accompanying drawings which illustrate a preferred embodiment of the present invention. FIG. 1 and FIG. 2 are illustrative views which schematically show the structure of a portion of an oven employable for a transverse stretching apparatus in accordance with the embodiment of the present invention. The oven 1 includes a conventional conveyor 2 at the central part thereof which extends in the longitudinal direction of the oven The conveyor 2 is constructed so as to move in the direction of arrow A while the opposite ends of a film W are grasped by an opposing pair or endless clips (not shown) to form a film passage.

The oven 1 also includes a case 3 made of a heat resistant material while having a rectangular section contour. The interior of the case 3 is divided into four treatment regions, i.e., a preheating region, a stretching region, a thermal curing region and a cooling region. A single nozzle module or a plurality of nozzle modules 4 are arranged in each treatment region so as to allow the film W conveyed by the conveyor 2 to be subjected to heat treatment. Each nozzle module 4 includes an opposing pair of air chambers 5 arranged on the opposite sides of the film passage and four nozzle units 6 alternately connected to the air chambers 5 along the film passage. Each air chamber 5 is integrated with the case 3, and as suction fans 8 are rotationally driven, a lower pressure region is formed so that the air chambers 5 suck air via radiators 7, vertically arranged at the central part of each of the opposite sides of the film passage, while heating the air. The heated air is distributively supplied into the respective nozzle units 6 through discharge ducts 9.

Each nozzle unit 6 has an upper nozzle 10 and a lower nozzle 11 which are spaced apart from each other by a predetermined distance so as to surround the film passage, across the entire width thereof, not only from above but also from below. Specifically, the upper nozzle 10 serves to blow hot air toward the film passage from above, while the lower nozzle 11 serves to blow hot air toward the film passage from below. The upper nozzle 10 is pivotally supported so as to pivot about an upper support shaft 13 disposed on the base end side of the upper nozzle 10 with the aid of a bracket 12. In addition, the upper nozzle 10 is pivotally connected to the air chamber 5 so as to be able to pivot about the upper support shaft 15 disposed on the base end side of the lower nozzle 11 with the aid of a bracket 15. In addition, the lower nozzle 11 is also pivotally connected to the air chamber 5 so as to be able to pivot about the lower support shaft 15 in the downward direction. On the other hand, the foremost end side of each of the nozzles 10 and 11 is operatively supported by an opening/closing unit 16. Specifically, the opening/closing unit 16 is constructed such that a sprocket 18 fixedly mounted on the support shaft 13 has an elongated flexible member 17, such as a chain or like, suspended therefrom. One end of the elongated flexible member 17 is operatively connected to the foremost end of the upper nozzle 10 and the other end of the same is operatively connected to the foremost end of the lower nozzle 11. It should be noted that the upper support shaft 13 is rotated in the normal/reverse direction by driving a driving unit (not shown). Thus, as the sprocket 18 for the opening/closing unit 16 is rotated in the direction of arrow B, the upper nozzle 10 is turned in the upward direction with the upper support shaft 13 as a fulcrum, while the lower nozzle 11 is turned in the downward direction with the lower support shaft 15 as a fulcrum. Accordingly, the nozzle unit 16 is opened in the vertical direction. At this time, since the weight of the upper nozzle 10 and the weight of the lower nozzle 11 are exerted on the elongated flexible member 17 in opposite directions relative to each other, the sprocket 18 can be rotationally driven with a driving force of a small magnitude.

According to the embodiment of the present invention, since each radiator 7 is arranged adjacent to the air chamber 5, i.e., on the film passage side while extending in the vertical direction, the upper and lower nozzles 10 and 11 of each nozzle unit 16 can be arranged independent of the location of radiators 7. In contrast with conventional ovens, the nozzles 10 and 11 are not required to have a stepped portion formed on the base end side thereof but can be fabricated in the straight fashion as shown in FIG. 1, resulting in their geometrical configuration being simplified. In addition, the adjacent nozzle units 6 are alternately connected to left and right air chambers 5, respectively, so that alternate air flow in opposing directions is performed in adjacent nozzle units 6. Accordingly, temperature gradients introduced by a nozzle unit 6 will be canceled by temperature gradients introduced by an adjacent nozzle unit 6. As a result, temperature distribution will be uniform over the entire width of the film passage.

Figure 3:
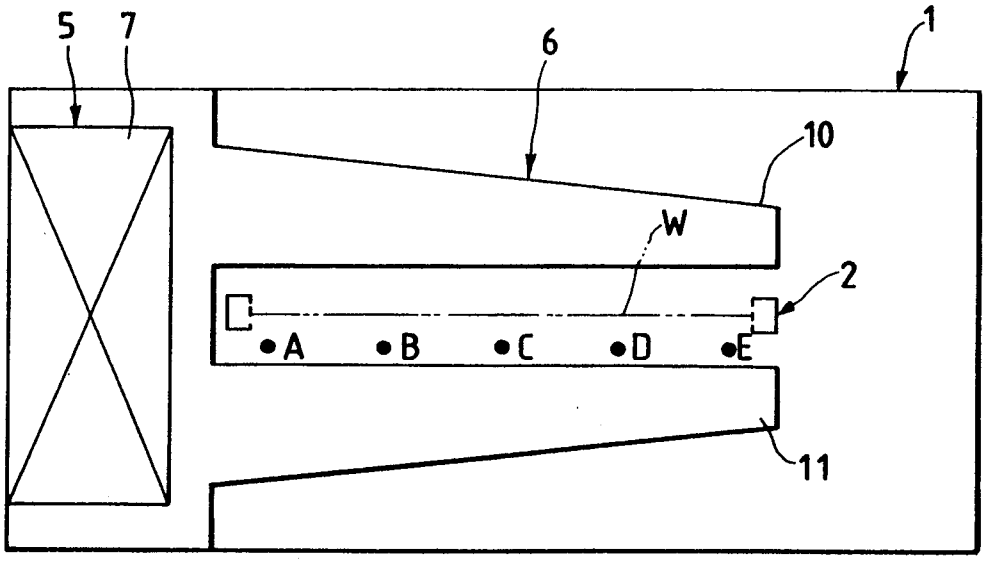
FIG. 3 is an illustrative view which shows temperature measurement locations on the oven for a transverse stretching unit to which the present invention is applied.

For example, in a case where the oven 1 in accordance with the embodiment of the present invention was employed for a transverse stretching apparatus having an effective film width of 2,000 mm, a working temperature of the nozzle module 4 was preset to 245° C. and measurements were conducted at five measuring points designated by A, B, C, D and E which were located in the transverse direction of the film passage as seen in FIG. 3. The results derived from the measurements are shown in Table 1.

TABLE 1

| Measuring Point | Temperature in the Course of Elevating | Temperature When a Preset Temperature is Reached |
|---|---|---|
| A Point | 142.0 | 240.8 |
| B Point | 142.4 | 240.6 |
| C Point | 142.4 | 240.7 |
| D Point | 142.8 | 240.8 |
| E Point | 142.8 | 241.0 |

Note: The respective temperatures shown on the Table are represented by °C. in unit.

As shown in Table 1, when the working temperature was elevated to the preset temperature, it was substantially uniformly distributed across the entire width of the film passage. It should be added that an intermediate temperature was also uniformly distributed across the entire length of the film passage in the course of elevating of the temperature. Subsequently, the film was subjected to stretching treatment so as to allow it to have a predetermined width. The results derived from measurements reveal that the resultant film product was excellent in respect to physical properties such as a strength, and optical properties, and the like, and had a uniform thickness, as viewed in the transverse direction of the film.

Also, if the film is broken for some reason during the stretching operation and the broken film needs to be removed form the oven 1, the opening closing units 16 are actuated to rotate the upper support shafts 13 in the direction of arrow B, causing the sprockets 18 to be rotated in the same direction. Thus, the flexible elongated members 17 are displaced likewise in the same direction. Since the upper and lower nozzles 10 and 11 of each nozzle unit 6 are supported on the base end side thereof to pivot about the support shafts 13 and 15, the upper nozzle 10 is displaced in the upward direction and the lower nozzle 11 is displaced in the downward direction as the flexible elongated members 17 are displaced in the above-described manner. In other words, the upper nozzle 10 is turned in the upward direction with the upper support shaft 13 as a fulcrum and the lower nozzle 11 is turned in the downward direction with the lower support shaft 15 as a fulcrum, whereby each nozzle unit 6 is opened in the vertical direction. Consequently, a sufficiently wide working space is reserved for an operator. Thus, the broken film can be easily removed from the oven 1. At this time, since the weight of the upper nozzle 10 and the weight of the lower nozzle 11 are exerted on the flexible elongated member 17 in opposite directions relative to each other, the upper nozzle 10 and the lower nozzle 11 can be easily opened in the vertical direction.

According to the present invention, since radiators are arranged on the film passage side relative to air chambers while extending in the vertical direction, upper and lower nozzles of each nozzle unit can be connected to each other without any interference with the arrangement of the radiators. Thus, in contrast with the conventional oven, it is not necessary to employ a complicated nozzle configuration. This makes it possible to create a uniform temperature distribution across the entire width of a film passage.

In addition, since each nozzle unit has an upper nozzle and a lower nozzle adapted to pivot in the vertical direction so as to open or close the nozzle unit, a sufficiently wide working space can be reserved for an operator so as to enable inspection, maintenance, removal of a broken film cleaning of the interior of the oven or the like to be easily performed. In a case where each nozzle unit is equipped with an opening/closing unit for simultaneously turning the upper and lower nozzles in the vertical direction, the nozzle unit can be opened or closed within a very short period of time. Especially, in a case where the opening/closing unit includes a flexible elongated member, rotational members can be rotated with a small magnitude of driving power, resulting in each nozzle unit being smoothly opened or closed.

The present invention has been described with reference to a preferred embodiment. Of course, modifications can be made thereto without departing from the scope of the invention as recited in the appended claims.

What is claimed is:

1. An oven employable for a transverse stretching apparatus, comprising:

a pair of air chambers, one of said air chambers being arranged on each side of a film passageway defined in the oven;

at least one radiator operatively coupled with each of said air chambers and extending above and below the film passageway in a direction substantially perpendicular to a length of the film passageway;

a plurality of nozzle units arranged in the oven, each nozzle unit being operatively connected to one of said air chambers and comprising an upper nozzle which extends across a width of the film passageway at a position above the film passageway and a lower nozzle which extends across a width of the film passageway at a position below the film passageway, said upper and lower nozzles being configured to direct hot air toward the film passageway; and a blower coupled with said air chambers so as to cause air to flow through said radiators into said air chambers and subsequently into said nozzle units;

said upper and lower nozzles being alternately connected to one of said air chambers through a hinged device so as to allow said upper nozzles to pivot upward and away from the film passageway and so as to allow said lower nozzles to pivot downward and away from said film passageway.

2. An oven as claimed in claim 1, wherein each nozzle unit is operatively connected to an opening unit which simultaneously drives said upper nozzle and said lower nozzle such that said upper nozzle is pivoted in the upward direction and said lower nozzle is pivoted in the downward direction.

3. An oven as claimed in claim 2, wherein said opening unit has an elongated flexible member suspended from a rotational member, the opposite ends of said elongated flexible member being operatively connected to the end of said upper nozzle and said lower nozzle which are remote from said hinged device.

* * * * *